United States Patent [19]

Lucas

[11] 4,445,407

[45] May 1, 1984

[54] METHOD AND APPARATUS FOR HANDLING BOOK TRIMMINGS

[75] Inventor: Anton V. Lucas, Long Prairie, Minn.

[73] Assignee: Koenig & Bauer/Egenolf Machine, Inc., Indianapolis, Ind.

[21] Appl. No.: 406,576

[22] Filed: Aug. 9, 1982

[51] Int. Cl.[3] ..... B26D 11/00

[52] U.S. Cl. ..... 83/27; 83/44; 83/104; 83/167; 83/255; 83/408; 83/923; 83/925 A

[58] Field of Search ..... 83/27, 44, 104, 167, 83/255, 408, 923, 925 A

[56] References Cited

U.S. PATENT DOCUMENTS

| | | | |
|---|---|---|---|
| Re. 28,840 | 6/1976 | Sarring | 83/255 X |
| 3,528,332 | 9/1970 | Thumin | 83/925 A X |
| 3,559,516 | 2/1971 | Freeman | 83/925 A X |
| 3,570,344 | 3/1971 | Bryson | 83/255 X |
| 3,570,350 | 3/1971 | Fegg | 83/925 A X |
| 3,722,336 | 3/1973 | Sarring | 83/255 X |
| 3,722,342 | 3/1973 | Vulcano | 83/925 R X |
| 3,733,947 | 5/1973 | Bryson | 83/925 A X |
| 3,811,350 | 5/1974 | Marciniack | 83/255 X |
| 3,841,182 | 10/1974 | Cosgrove | 83/255 X |
| 4,188,845 | 2/1980 | Stukenberg | 83/408 X |
| 4,300,427 | 11/1981 | Rathert | 83/925 A |

*Primary Examiner*—James M. Meister

*Attorney, Agent, or Firm*—Woodward, Weikart, Emhardt & Naughton

[57] ABSTRACT

A trimming apparatus for receiving from a book trimmer the elongated glued book trimmings which have a glued end at one end in the elongated direction and for trimming the glued end. The apparatus comprises a chute for receiving the book trimming and placing the trimming between a chain belt conveyor which has receptacles for those trimmings. The trimmings are moved along the conveyor to and between a pair of rotary cutting blades so that the glued portion of the trimming is cut from the unglued portion of the trimming. The portions are separated so that the glued portions fall into one bin and the clean paper portions fall into a second bin. A related method for separating the glued end of a book trimming from the remainder of the trimming is also disclosed.

14 Claims, 6 Drawing Figures

METHOD AND APPARATUS FOR HANDLING BOOK TRIMMINGS

BACKGROUND OF THE INVENTION

1. Field of the Invention

This invention relates in general to a method and apparatus for handling book trimmings and, more particularly, to a method and apparatus for separating the glued portion of a book trimming from the unglued portion of a book trimming and collecting the two portions separately.

2. Description of the Prior Art

Many books, magazines, and other documents are bound together by gluing together the separate pages of paper along a common edge. These stacks of paper which make up the book, magazine or other document which have a glued edge which bind them together are then put through various types of trimming apparatus for the purpose of trimming off excess paper so that the book, magazine or other document will have straight edges and be the appropriate size. One example of a patented device which does trimming of this type is the three knife trimmer of the Rathert U.S. Pat. No. 4,300,427. The typical trimming that is trimmed from these bound books and stacks of paper is about 3/16" wide and as tall as the thickness of the book or magazine.

When the excess paper is trimmed from a book or magazine there is usually a cut made along three sides of the rectangular shape of the book or magazine. The side that is not cut of course is the side that is bound together by the glue or other means. Therefore essentially two types of book trimmings result. One book trimming is the excess paper that was cut from the edge opposite the bound edge of the book. This book trimming is excess paper and is easily collected and recycled. The other two trimmings are cut from the edges which are perpendicular to and adjacent to the glued bound edge. Therefore these book trimmings are glued together at one edge.

In modern glue binding a hot melt glue which is made of plastic is very often used. When this hot melt plastic is included in the portion of the trimmings previously described, these trimmings are not easily recycled because this hot melt glue plastic is not recyclable along with the rest of the paper. Therefore, a large portion of paper is wasted because it has to be thrown away because a portion of it contains this plastic hot melt glue. In the past when animal glue was more prevalently used these scraps of paper containing animal glue could be thrown in with the rest of the clean scraps of paper and be recycled because the animal glue is recyclable. However, the current use of the plastic hot melt glue means that these scraps of paper have to be thrown away and this constitutes a tremendous waste of good paper.

It would be a tremendous advantage to have a method or device which could take the glued book trimmings directly from the book trimming machines and cut off the glued portion and retain the unglued portion so that it could be recycled. In this way, paper that is now being wasted could be easily, efficiently and inexpensively accounted for and recycled. The present invention provides for such a method and apparatus for collecting from the book trimming machines these glued book trimmings and then cutting off the small glued portion and separating the unglued portion so that it can be collected and recycled.

The prior patented devices in the area of book trimming generally disclose devices for trimming books and do not disclose devices which would be suitable for the purpose of trimming the glued portion of the glued book trimming so as to save paper. In fact these prior art patented devices all would need a device as in the present invention so that the glued book trimming could be recycled more effectively. Examples of book trimming machines are in the following U.S. Pat. Nos. 4,300,427, issued to Rathert on Nov. 17, 1981; 4,188,845, issued to Stukenberg on Feb. 19, 1980; 3,841,182, issued to Cosgrove et al. on Oct. 15, 1974; 3,811,350, issued to Marciniak on May 21, 1974; 3,733,947, issued to Bryson et al. on May 22, 1973; 3,722,336 issued to Sarring on Mar. 27, 1973; 3,722,342, issued to Vulcano on Mar. 27, 1973; Re. 28,840, reissued to Sarring on June 8, 1976; 3,570,350, issued to Fogg on Mar. 16, 1971; 3,570,344, issued to Bryson on Mar. 16, 1971; 3,559,516, issued to Freeman on Feb. 2, 1971; and 3,528,332, issued to Thumim on Sept. 15, 1970.

None of these patents discloses a device for handling the glued book trimings so as to separate the glued portion and retain the unglued portion for recycling. Further, none of these devices is readily adaptable for this purpose. Therefore the present invention provides for a method and apparatus which can be used in conjunction with many of these devices to separate the small glued portion from the book trimmings and thus recycle a great deal of paper that has gone to waste in the past.

SUMMARY OF THE INVENTION

A trimming apparatus for receiving from a book trimming apparatus the elongated book trimmings which have a glued end, the apparatus comprising means for receiving the elongated glued book trimmings and for orientating them in a first orientation so that the elongated direction is in a first direction and the glued end is in a first plane perpendicular to the first direction. Further included is a transfer means for receiving the elongated glued book trimmings in the first orientation and for transferring the trimmings to a cutting location while maintaining the trimmings in the first orientation. Also included is a cutting means located at the cutting location for cutting off the glued end with a cut in a second plane parallel to the first plane, and separation means for collecting the cut glued end separate from the remainder of the book trimming.

It is an object of this invention to provide an improved method and apparatus for handling glued book trimmings so that the glued portion is separated from the unglued portion.

Related objects and advantages of the present invention will be apparent from the following description.

DESCRIPTION OF THE PREFERRED EMBODIMENT

Figure 1:
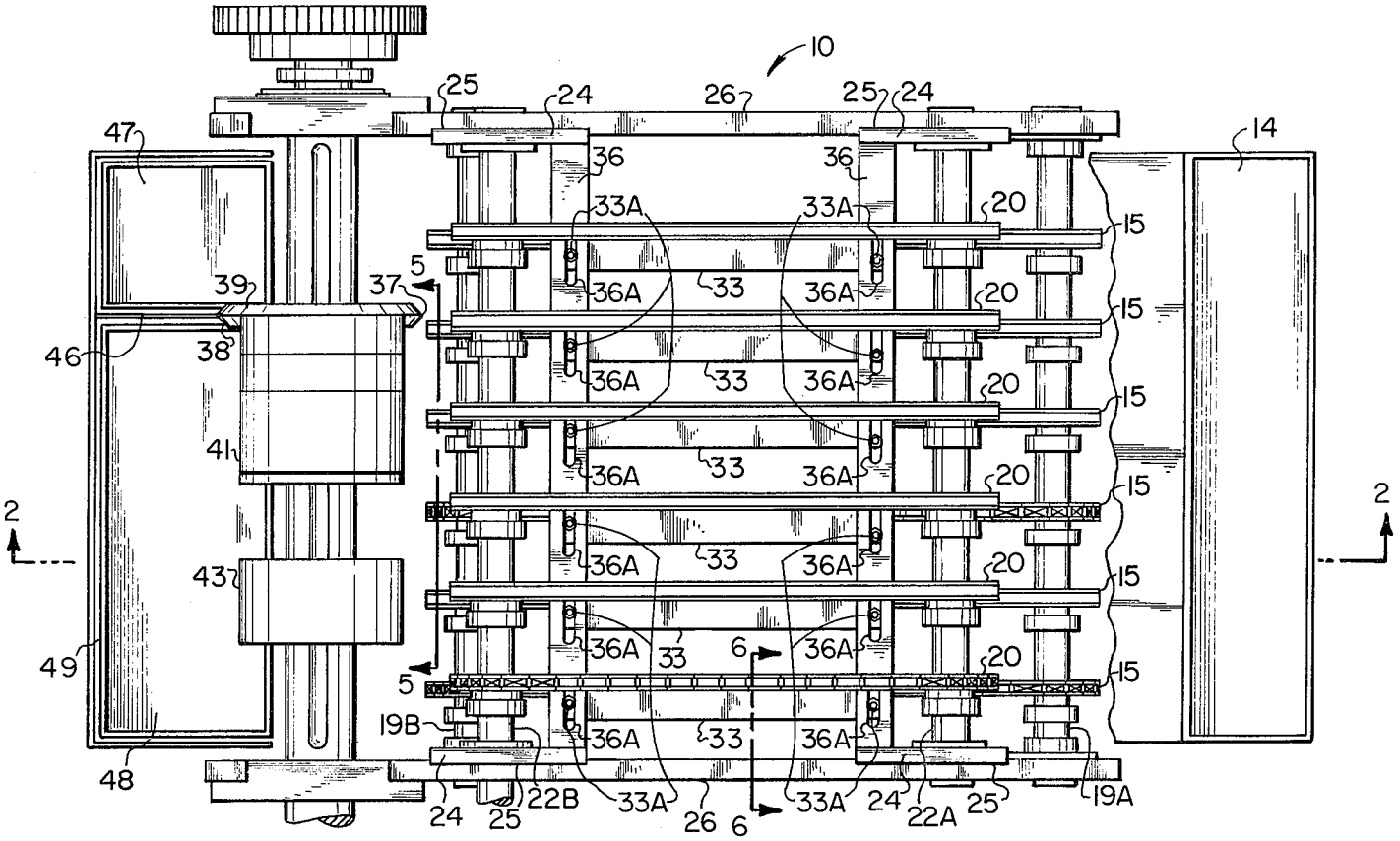
FIG. 1 is a top, plan view of the book trimming apparatus of the preferred embodiment.

For the purposes of promoting an understanding of the principles of the invention, reference will now be made to the embodiment illustrated in the drawings and specific language will be used to described the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
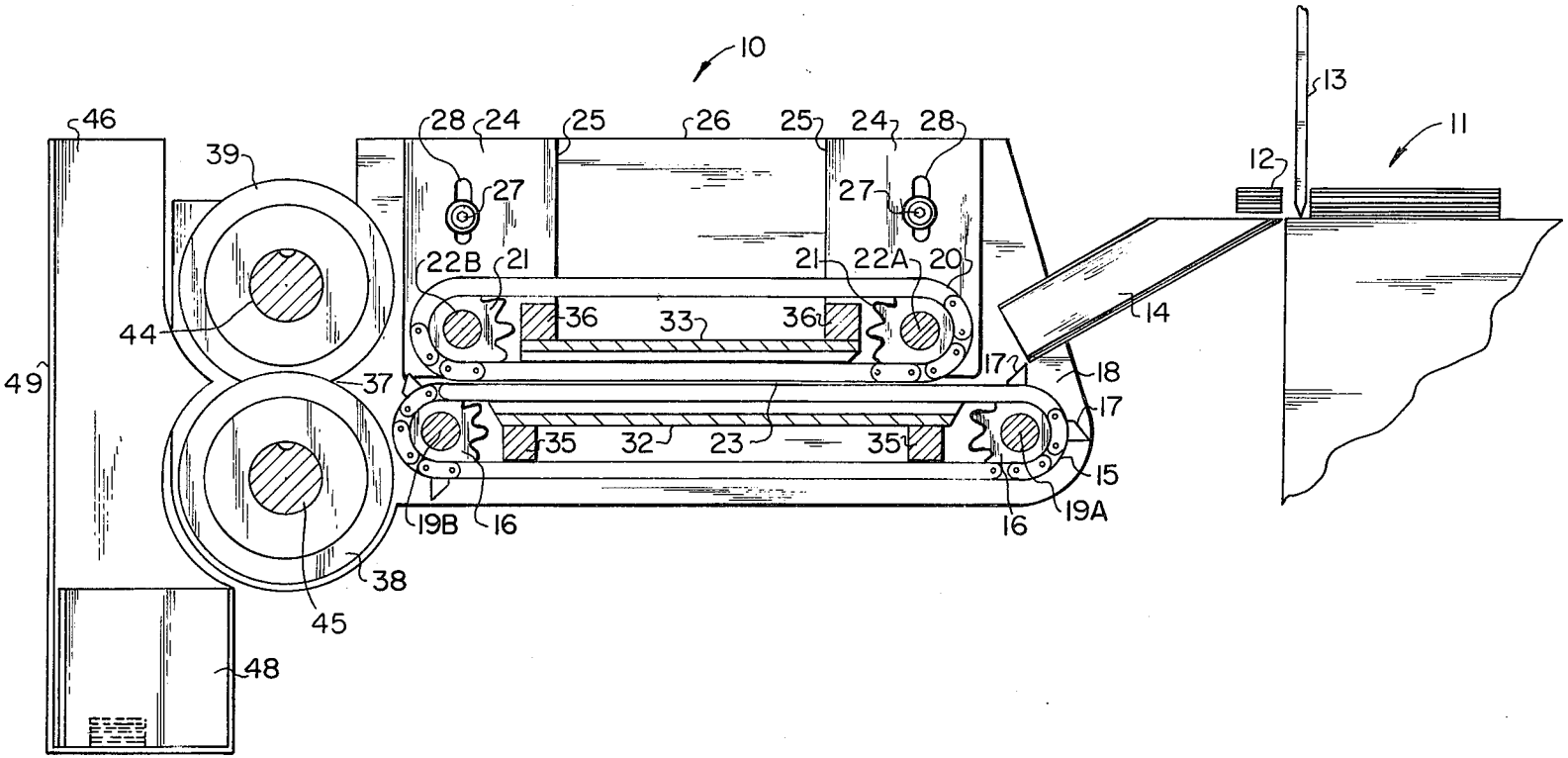
FIG. 2 is a side, cross-sectional view of the book trimming apparatus of FIG. 1.

Referring to FIGS. 1 and 2 there is shown a trimming apparatus 10 for receiving from a book trimming apparatus 11 the elongated glued book trimmings 12. The book trimming apparatus 11 is not a part of this invention and is only shown for illustrative purposes. The apparatus 10 includes a trimming receiving means, consisting of a chute 14 in the preferred embodiment. The receiving chute 14 is a simple way that book trimmings 12 can be delivered to the apparatus 10 from the book trimmer 11 while maintaining them in a consistent orientation so that the apparatus 10 will receive the trimmings 12 with the glued end always in the same direction. Other mechanisms for achieving this result with various book trimming devices are possible.

In the device shown, the book trimming 12 is cut from the book by the guillotine blade 13. The book trimming 12 falls into the chute 14 and slides down the chute and onto the bottom chain belts 15 of the trimmer 10. The book trimming is engaged by the ribs 17 which project upwardly from the links of the bottom chain belt 15. These ribs are spaced so that they form book trimming receptacles 18. The book trimming thus is received from the book trimmer 11 and falls through the chute 14 and lies on the bottom chain belts 15 in an orientation or direction perpendicular to the direction of travel of those chain belts.

As the bottom chain belts 15 by the rotation of the bottom chain belt sprockets 16 which are fixed on and rotated by the bottom axles 19A and 19B, the book trimming is moved within that receptacle 18 and held in place from the top by the top chain belts 20 which are similarly run by the rotation of the top chain belt sprockets 21 which are fixed on and rotated by the top chain belt axles 22A and 22B.

Thus the book trimming moves through the channel 23 which is formed by the top chain belt and the bottom chain belt. The height of this channel 23 is adjustable for various height book trimmings by adjusting the top chain belts 20 and top chain belt axles 22A and 22B. This height adjustment ensures that the trimming 12 remains secure in the channel 23 because it is secured by the top chain belt in the receptacle 18 so that the apparatus 10 can be run at high speeds.

Figure 3:
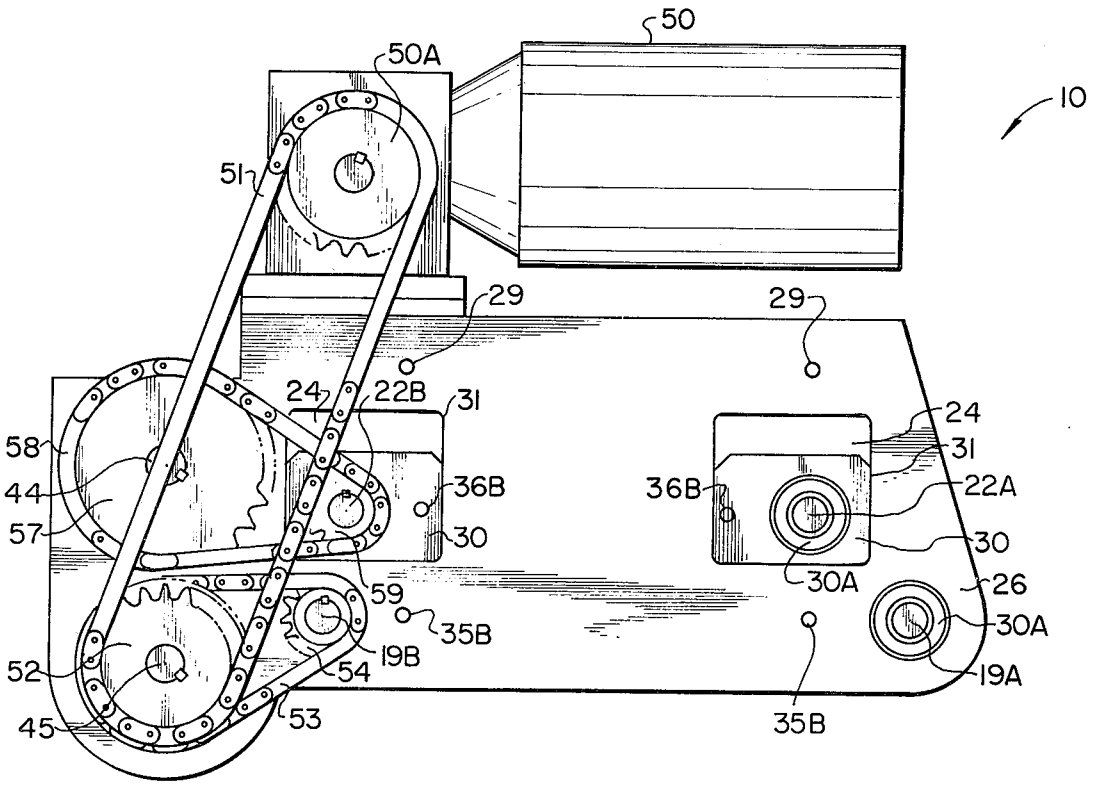
FIG. 3 is a left side elevation view of the apparatus of FIG. 1.

The height adjustment is accomplished by the top chain belt axles 22A and 22B being mounted to slidable plates 24 which can be slid up or down in a recesses 25 which are in the side of the apparatus housing 26. Then the plates 24 are locked in place at the desired height by the tightening of the locking washers and bolts 27 in the plate slots 28 so that the bolts 27 thread into threaded channels 29 in the housing 26. The washer and bolts 27 hold the plates 24 in place. As can be seen in FIG. 3 these plates 24, in the preferred embodiment, are also attached to the outside plates 30 to which the axles 22A and 22B are also rotatably mounted by appropriate bearing means 30A known in the art. The bottom chain belt axles 19A and 19B are also rotatably mounted by appropriate bearing means 30A to the housing 26. The outside plates 30 slide in the slots 31 which are height adjusting slots so that when the interior plates 24 are slid up it will only go as far as the exterior plates 30 will go up in slots 31.

Figure 6:
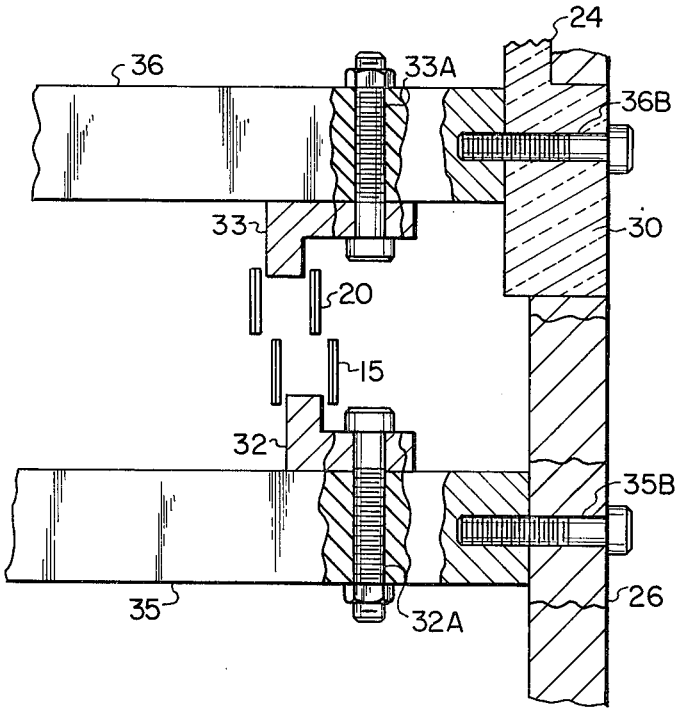
FIG. 6 is a front, cross-sectional view of the chains of the conveyor and the chain guides for those chains of the apparatus of FIG. 1.

The apparatus includes bottom chain guides 32 for the bottom chain belts and top chain guides 33 for the top chain belts. As shown in FIG. 6, these guides guide the chains so that the chains are restrained by the guides and do not wabble in a tranverse direction and keep a true course thus ensuring that the machine can be run at high speeds. Further these chain guides are respectively connected to cross bars 35 and 36 by nuts and bolts 32A and 33A through slots such as 36A, as is shown in FIG. 1. Slots such as 36A are provided in the cross bars so that the chain guides can be adjusted laterally if necessary for smooth operation. The bottom cross bars 35 are rigidly attached to the housing 26 by bolts 35B which are threaded through the housing 26 and into the end of the bars 35. The top cross bars 36 are rigidly attached by bolts 36B, which thread through the plates 24 and 30 and into the end of the bars 36, to sliding plates 24 and 30 so that when the top chain belts 20 are adjusted in height the guides, because they are attached to the plates 24 and 30, will also move up and down the same distance. These bars can also be so attached by other known means.

The chain drives, while the trimming is in the receptacle 18, run the trimming through the apparatus and to the cutting location 37 where the cutting means which are the two rotary cutting blades 38 and 39 are disposed. The two blades overlap at point 37 so that a cutting action at 37 occurs when the book trimming shoots through there from the momentum it gains as it is moved along by the chain drives. The apparatus functions at a high rate of speed and the momentum provided by the conveyor chains to the trimming 12 shoots it to the rotating cutting blades where the blades grab hold of the trimming and cut it. Thus a cut is made at a point such that the glued portion of the book trimming is cut away from the unglued portion. The cut will occur at this point because the blades are set up transversely to the direction of travel of the trimming 12 and the trimming is received from the trimmer 11 and maintained by the apparatus 10 in an orientation where the blades will properly cut off the glued portion.

Figure 5:
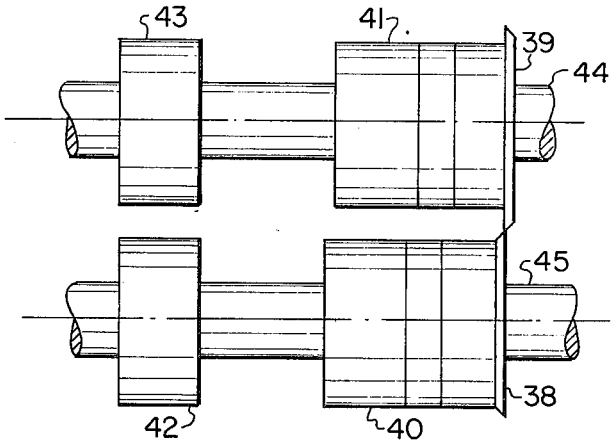
FIG. 5 is a partial front elevation view of the cutting blades of the apparatus of FIG. 1.

Because the device operates at high speeds, as do the cutting devices 11, the book trimmings essentially are shot through these blades and the cylinder guides 40, 41, 42 and 43, which are fixed on and rotated by the cutting blade axles 44 and 45 respectively as in FIG. 5, ensure that the trimming does not wabble too much in its journey through the cutting location. The cylinder guides 40 and 41 also serve as mounting cylinders, as is known in the art, for the top and bottom blades, so that these blades can be fixedly mounted to the blade axles 44 and 45 so that the blades will be rotated by the axles as is shown in FIG. 5.

The book trimming is thereby cut and is then separated vertically by the separation blade 46. This separation blade 46 ensures that the portion of the paper that is cut to the left side of the blades goes to the left of the separation blade 46 and the book trimming that is cut to the right side of the blades goes to the right side of the separation blade. Therefore this ensures that the glued portions fall into bin 47 and the unglued portions fall into bin 48. The back wall 49 ensures that as the trimmings shoot through they do not go flying off but hit this back wall and then fall because of gravity into their respective bins. In this way a separation means for collecting and separating the cut glued ends from the remainder of the book trimming is provided for.

Figure 4:
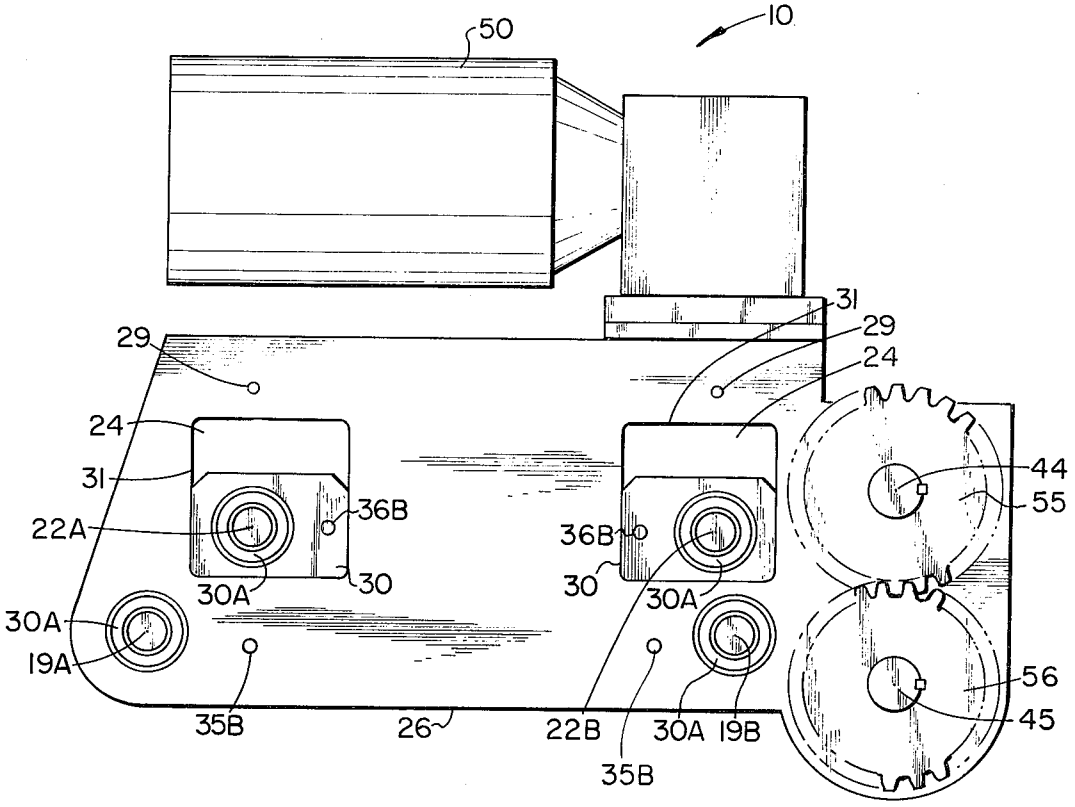
FIG. 4 is a right side elevation view of the apparatus of FIG. 1.

The entire device is run by suitable gearing and motor means 50 which drives by sprocket 50A and power drive belt 51 the sprocket 52 which is connected to and drives the lower cutting axle 45. The sprocket 52 engages a belt 53 which is connected to a sprocket 54 which is connected to and drives the lower chain axle 19A. The upper cutting axle 44 is connected to and run by sprocket 55 which engages sprocket 56 which is connected to and run by the cutting axle 45 which is run by the opposite sprocket 52. Finally, sprocket 57 is connected to and run by the upper cutting axle 44. A belt 58 transmits the motion of sprocket 57 to sprocket 59 which is attached to and runs the axle 22A of the upper chain drive. Because of the interconnection of the driving means as shown in FIGS. 3 and 4, the entire device is synchronized. Of course these motor means in the chain and sprocket drives are but one embodiment and there are many methods for simultaneously driving various axles that need to be driven for the device to move the book trimmings through it so that they will be cut and separated. The preferred embodiment provides for the running engagement of sprockets 55 and 56 on the opposite side of the cutting blade axles 44 and 45 so that cutting blades will rotate uniformly and thus ensure smooth and clean cuts.

The device disclosed embodies the method of this invention by simply stated the method is as follows: The method of this invention is to receive the book trimmings from the book trimmer in a first orientation and then to maintain them in that orientation throughout the process. The trimmings are taken by a conveyor and the glued portion is cut from the unglued portion by, for example, a rotary blade. The glued portion is then separated from the unglued portion and received in two separate bins. In this way the bin with the edges that have a glued portion can be thrown away as useless or else otherwise recycled for the glue, and the bin containing the clean paper can be recycled so that this paper is not wasted as it was in the past.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A trimming apparatus for (1) receiving from a book trimming apparatus the elongated glued book trimmings which have a glued end and for (2) trimming the glued end, said apparatus comprising:

trimming receiving means for (1) receiving the elongated glued book trimmings from the book trimming apparatus and for (2) orientating the elongated glued book trimmings in a first orientation so that the elongated direction is in a first direction and the glued end is in a first plane perpendicular to said first direction;

transfer means for (1) receiving said elongated glued book trimmings in said first orientation from said receiving means and for (2) transferring said trimmings to a cutting location while maintaining said trimmings in said first orientation;

cutting means located at said cutting location for (1) receiving said trimmings in said first orientation and for (2) cutting off said glued end with a cut in a second plane parallel to said first plane;

separation means for collecting the cut glued end separate from the remainder of the book trimming.

2. The apparatus of claim 1 wherein said first direction is perpendicular to the direction of transfer of the trimming by the transfer means.

3. The apparatus of claim 2 wherein said second plane is adjacent to said glued end.

4. The apparatus of claim 3 wherein said cutting means includes a top rotary blade and a bottom rotary blade and said top blade is in said second plane and said bottom blade is in said second plane below said top blade and the blades define a cutting channel, and blade rotation means for rotating said top blade in one direction and said bottom blade in the opposite direction so that the elongated glued book trimming travels through said cutting channel and is cut in said second plane.

5. The apparatus of claim 4 wherein said transfer means include a lower conveyor means and an upper conveyor means spaced apart and above said lower conveyor means and defining a trimming transfer channel between said lower and upper conveyor means, and spacing adjustment means for adjusting the space between said upper and lower conveyor means, thus altering the height of the trimmings transfer channel.

6. The apparatus of claim 5 wherein said lower conveyor means includes a plurality of upwardly projecting ribs defining book trimming receptacles.

7. The apparatus of claim 6 wherein said separation means includes a first bin and a second bin arranged so that the glued end portions are received in the first bin and the ramainder non-glued book trimming portions are received in the second bin.

8. The apparatus of claim 1 wherein said cutting means includes a top rotary blade and a bottom rotary blade and said top blade is in said second plane and said bottom blade is in said second plane below said top blade and the blades define a cutting channel, and blade rotation means for rotating said top blade in one direction and said bottom blade in the opposite direction so that the elongated glued book trimming travels through said cutting channel and is cut in said second plane.

9. The apparatus of claim 8 wherein said transfer means include a lower conveyor means and an upper conveyor means spaced apart and above said lower conveyor means and defining a trimming transfer channel between said lower and upper conveyor means, and spacing adjustment means for adjusting the space between said upper and lower conveyor means, thus altering the height of the trimmings transfer channel.

10. The apparatus of claim 1 wherein said transfer means include a lower conveyor means and an upper conveyor means spaced apart and above said lower conveyor means and defining a trimming transfer channel between said lower and upper conveyor means, and spacing adjustment means for adjusting the space between said upper and lower conveyor means, thus altering the height of the trimmings transfer channel.

11. The apparatus of claim 10 wherein said lower conveyor means include a plurality of upwardly projecting ribs defining book trimming receptacles.

12. A trimming method for receiving from a book trimming apparatus the elongated glued book trimmings which have a glued end at one end in the elongated direction and for trimming the glued end, said method comprising the steps of:

a. receiving the elongated glued book trimmings from the book trimming apparatus and orientating the elongated glued book trimmings in a first orientation so that the elongated direction is in the first direction and the glued end is in a first plane perpendicular to said first direction;

b. transferring said elongated glued book trimmings in said first orientation to a cutting location while maintaining said trimmings in said first orientation;

c. cutting off said glued end with a cut in a second plane parallel to said first plane;

d. separating and collecting the cut glued ends separatly from the remainder of the elongated book trimmings.

13. The method of claim 12 wherein said first direction is perpendicular to the direction of transfer.

14. The method of claim 13 wherein said second plane is adjacent said glued end.

* * * * *

UNITED STATES PATENT AND TRADEMARK OFFICE

CERTIFICATE OF CORRECTION

PATENT NO. : 4,445,407

DATED : May 1, 1984

INVENTOR(S) : Anton V. Lucas

It is certified that error appears in the above-identified patent and that said Letters Patent is hereby corrected as shown below:

"Attorney, Agent, or Firm - Woodward, Weikart, Emhardt & Naughton" should read --Attorney, Agent, or Firm - Woodard, Weikart, Emhardt & Naughton--

In column 6, line 42, "ramainder" should read --remainder--

In column 8, lines 8-9, "separatly" should read --separately--

Signed and Sealed this

*Twenty-eighth* Day of *August 1984*

(SEAL)

*Attest:*

GERALD J. MOSSINGHOFF

*Attesting Officer*

*Commissioner of Patents and Trademarks*